US005269633A

United States Patent [19]

Cornelis de Roo et al.

[11] Patent Number: 5,269,633

[45] Date of Patent: Dec. 14, 1993

[54] TUNNEL SHUTTERING

[75] Inventors: John P. Cornelis de Roo, Gouda; Willem J. Feijth, Kampen, both of Netherlands

[73] Assignee: Gadon Holding BV, Ijsselstein, Netherlands

[21] Appl. No.: 911,753

[22] Filed: Jul. 10, 1992

[30] Foreign Application Priority Data

Jul. 10, 1991 [DK] Denmark ..... 9101215

[51] Int. Cl.[5] ..... E21D 11/00; E21D 5/12

[52] U.S. Cl. ..... 405/288; 405/146; 405/150.1

[58] Field of Search ..... 405/146, 151, 150.1, 405/288, 291, 290, 297; 74/105

[56] References Cited

U.S. PATENT DOCUMENTS

| | | | |
|---|---|---|---|
| 2,650,475 | 9/1953 | Gerlach | 405/290 |
| 3,601,996 | 8/1971 | Levy | 405/290 |
| 4,261,542 | 4/1981 | Lefebvre | 405/150.1 X |
| 4,315,701 | 2/1982 | Ivanov et al. | 405/150.1 |
| 4,561,282 | 12/1985 | Hadden | 74/105 X |

FOREIGN PATENT DOCUMENTS

| | | | |
|---|---|---|---|
| 622786 | 12/1935 | Fed. Rep. of Germany | 405/288 |

*Primary Examiner*—Dennis L. Taylor

*Attorney, Agent, or Firm*—Bauer & Schaffer

[57] ABSTRACT

The invention relates to a tunnel shuttering, divided into two sections according to a dividing line lying in the plane of the horizontal panel of the shuttering and extending in the longitudinal direction of the tunnel. The tunnelsections may be coupled with one another by a number of connecting links, each of which having one end pivotally connected to one tunnel section about an axis standing in the longitudinal direction of the tunnel and adapted to have the other end removably "hooked" about a projection on the other tunnel section. Furthermore an auxiliary connecting link of a shorter length is provided, the ends of which are pivotally connectable to said other tunnel section and to an intermediate point of the connecting link respectively. Due to this the tunnel shuttering may be selectively used according to the half-tunnel-mode or according to the full-tunnel-mode.

10 Claims, 5 Drawing Sheets

TUNNEL SHUTTERING

The invention relates to a tunnel shuttering, comprising two upright shuttering panels and a lying shuttering panel that bridges the former, said lying panel being divided into two sections along a longitudinally extending dividing line, said sections being each rigidly connected to an upright shuttering panel and delimited at their opposite longitudinal edges by an angle iron, said angle irons having horizontally positioned flanges, which lie substantially in the upper plane of the respective panel sections and which have their free longitudinal edges facing towards and substantially touching each other when in the operative shuttering position, the two sections being —in said operative shuttering position—coupled by means of a plurality of connecting links spaced along the longitudinal direction of the tunnel shuttering and positioned in planes at right angles to the longitudinal direction of the tunnel shuttering, the ends of said connecting links having an opening about a longitudinally extending pivot pin supported by a bracket adjacent the vertical flange of the respective angle iron.

Such a tunnel shuttering is disclosed in FR-A-2.217.973 (vide in particular FIG. 5 and 6).

With this well-known tunnel shuttering the two openings of each connecting link are performed as circumferentially closed openings and one of the pivot pins is carried out as a removable locking pin so as to connect and disconnect the two tunnel sections to and from each other respectively.

In this case a tunnel system is involved, in which the two tunnel sections are independently, as a so-called "half" tunnel, put in place and then connected by means of the said connecting links to form a complete tunnel. After pouring and setting of the wall and floor formations the tunnel sections are also independently—i.e. as a "half" tunnel—removed from the pouring location after having been disconnected from each other by removal of the locking pins and after having first caused one of said sections to lower slightly with respect to the other, due to which both of said sections have become released from the finished vertical walls.

It is a drawback of this well-known embodiment that already during the manufacturing of the shuttering sections it is very difficult, if at all possible, to have the cooperating openings in the brackets and the connecting links in sufficiently accurate alignment. In practice therefor the introduction of the locking pins is often very difficult, whereas the removal of the locking pins may also be difficult. It is to be remarked that the use of a certain clearance could improve the ease of introduction and removal of the locking pins, but would lead to a poor coupling between the two tunnel sections.

A first object of the invention is to improve the above well-known coupling of the tunnel sections, based on the "half-tunnel-mode" in the sense that the above mentioned drawback is removed.

According to the invention this aim is achieved in that the opening at one end of each connecting link is constituted by the bottom of a slot which opens into the upper edge of the link and in that a locking rod is pivotally suspended adjacent the fixedly mounted pin that cooperates with this slot-shaped opening, said rod being provided with a pressure member mounted to be slidably moved along said rod and to be fixed relative to said rod, said member being adapted to engage said connecting link to urge the latter to enter with its slot-shaped opening into engagement with the respective pivot pin.

It will be understood, that it is possible to make the slot-shaped portion of the opening, as modified by the invention, relatively wide as compared with the pivot pin diameter, so that in each case it will not offer any difficulty for initial engagement between the respective connecting link and the respective pin (which has become a fixed pin). The improved structure of the invention also enables the locking rod to be placed into its operative position —with the slidably mounted pressure member engaging the connecting link—and then displace the pressure member along the locking rod towards the pivot pin so as to urge the connecting link to enter into engagement with said pin.

Preferably the pivot pins are positioned between brackets provided in the dihedral angle of the respective angle irons, in such a way, that the connecting links—in the pouring position—have their upper edges in direct contact with the lower faces of the aligned horizontal angle iron flanges. In this manner the connecting links contribute in having the horizontal angle iron flanges exactly in one plane when moving into the operative (pouring) position of the shuttering.

A further object of the invention is to provide a further improvement of or addition to the tunnel shuttering obtained in accordance with said first object, in such a way, that this tunnel shuttering may be selectively used according to the "half-tunnel-mode" or according to the "full-tunnel-mode" by adding or removing respectively of auxiliary elements of a simple construction. In the full-tunnel-mode of such a tunnel shuttering an improvement of the well-known full tunnel embodiment is aimed at as well.

In the full-tunnel-mode the two tunnel sections are permanently coupled and jointly (mostly by means of a heavier type of crane) put in place and jointly displaced from under the finished tunnel structure.

In accordance with the invention this second object is also achieved in that an auxiliary link of shorter length is provided, having one end in permanent engagement with the pin cooperating with the slot-shaped opening of the connecting link and having its other end pivotally mounted about a pin extending from the connecting link at an intermediary point of the latter. The thus formed coupling lock has two end positions, viz. a closed, stretched position and a collapsed end position. In the closed, stretched position the (main) connecting link is in the coupling position, i.e. with its slot shaped opening in engagement with the respective pin, while the two shuttering sections are interconnected with the upper sides of the latter lying flush relative to one another. In this position the connection between the two tunnel sections in fact corresponds with that having a closed connecting link without an auxiliary link, and where the locking rod may fulfil a similar function in this situation.

In the situation just referred to the three pivot pins are lying substantially in one plane, while the auxiliary link is extending substantially parallel to the (main) connecting link and in fact does not fulfil any coupling function.

The auxiliary link particularly plays its role in the collapsed end position of the coupling lock and during the displacement between the two end positions. In the collapsed end position the (main) connecting link has its slot-shaped opening out of engagement with the respective pin and extends from its permanent pivot pin downwardly. The two tunnel sections, however, are kept connected with each other and may thus be handled jointly, such as by means of a crane, according to the well-known full-tunnel-mode.

In the collapsed position the locking rod carrying tunnel section will be positioned slightly lower and inwardly tilted relative to the tunnel section carrying the downwardly hanging connecting link, in a similar way as with certain well-known tunnel shutterings operating in the full-tunnel-mode.

Preferably, in the downwardly hanging end position of the connecting link, the third intermediate pivot pin is positioned slightly offset—towards the locking rod carrying pivot pin—relative to the vertical line through the upper, permanent pivot pin. The "sagged" tunnel may then be simply elevated into its operative position by means of a crane engaging the auxiliary link carrying tunnel section, as the pulling force exerted therewith will provide a momentum about the permanent pivot link, under the action of which the (main) connecting link will be guided into its coupled position.

A different and simpler way to bring the coupling lock from the collapsed position into the stretched coupled position is offered by the rocking rod; for this purpose the latter is swung outwardly towards the downwardly hanging connecting link to such an extent, that the pressure member in its lower position on this rod will engage the downwardly hanging connecting link. By subsequently moving the pressure member along the locking rod upwardly, the connecting link will be brought gradually—under the guidance of the auxiliary link—into its stretched coupled position and simultaneously locked.

Further features of the tunnel shuttering according to the invention will be hereinafter further explained, by way of example, with reference to the accompanying drawing.

With reference to FIGS. 1A-1D and 2A-2D the tunnel shutterings diagrammatically shown therein comprise two upright shuttering panels 1 and 2 and a horizontal shuttering panel 3 that bridges the panels 1 and 2. The horizontal shuttering panel 3 is divided along a line extending in the longitudinal direction of the tunnel, into two sections 3*a* and 3*b* respectively. Each of the sections 3*a* and 3*b* is rigidly connected to an upright shuttering panel 1 and 2 respectively . At their opposite longitudinal edges, each of the sections 3*a* and 3*b* is delimited by an angle iron 5 and 6 respectively having horizontal flanges 5*a* and 6*a* respectively lying in the upper plane of the respective horizontal panel section 3*a* and 3*b* respectively.

Figure 1A:
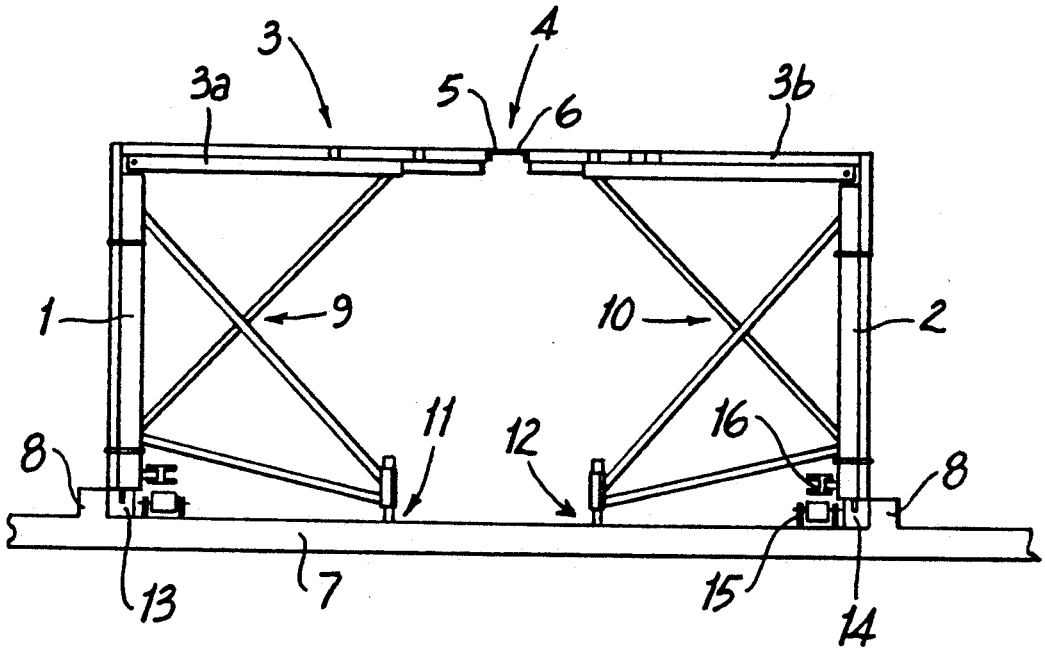
FIG. 1A shows a diagrammatic end view of a tunnel shuttering according to the half-tunnel-mode and in the coupled or shuttering position.
Figure 1B:
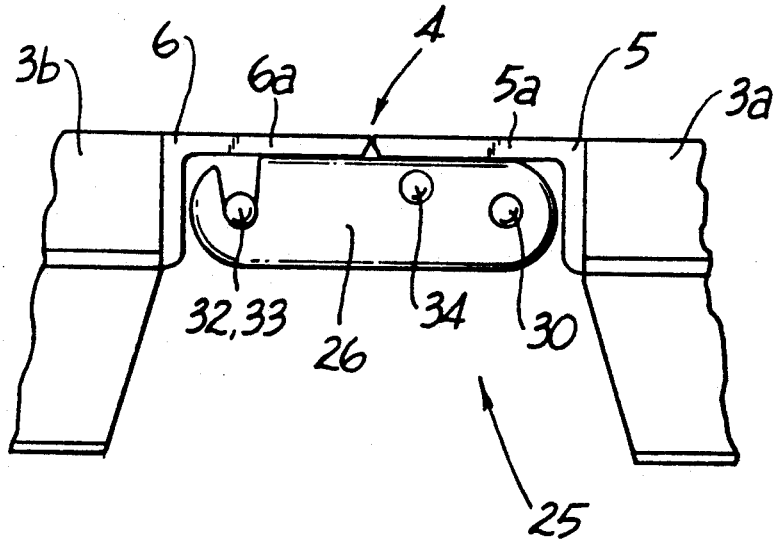
FIG. 1B shows the clamping lock according to the invention, that connects the two shuttering tunnel sections of FIG. 1A, wherein the auxiliary link is omitted and the locking rod is not shown for sake of clarity.

FIG. 1A shows the tunnel shuttering, as used according to the half-tunnel-mode and in a position ready for pouring the concrete, i.e. with the angle iron flanges 5*a* and 6*a* lying in one plane and with their longitudinal edges substantially touching each other. The shuttering panels 1 and 2 have been adjusted to the desired height and are at their lower end laterally supported by "ridges" 8 projecting upwardly from an existing floor 7. The two tunnel sections are held in the pouring position by being mutually coupled by means of the coupling lock 25 shown in FIG. 1B. The coupling or clamping lock will be hereinafter explained in more detail. Prior to being placed is the pouring position of FIG. 1A the two shuttering tunnel sections are independently placed, e.g. by means of a relatively light-weight crane, onto the floor 7. Support structures 9 and 10 with downwardly extendable support wheels 11 and 12 respectively, serve as a temporary support for the uncoupled tunnel sections. The adjustment of the shuttering to the desired height is effected by means of jacks 13 and 14 provided on the upright shuttering panels.

Figure 1C:
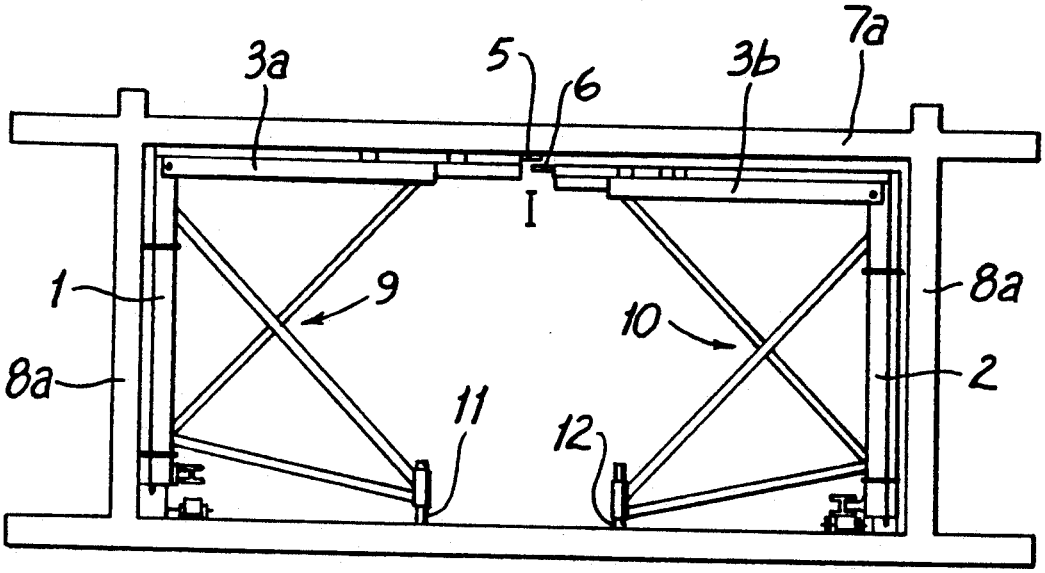
FIG. 1C shows a diagrammatic end view of the tunnel shuttering of FIG. 1A, in the disconnected or stripping position.
Figure 1D:
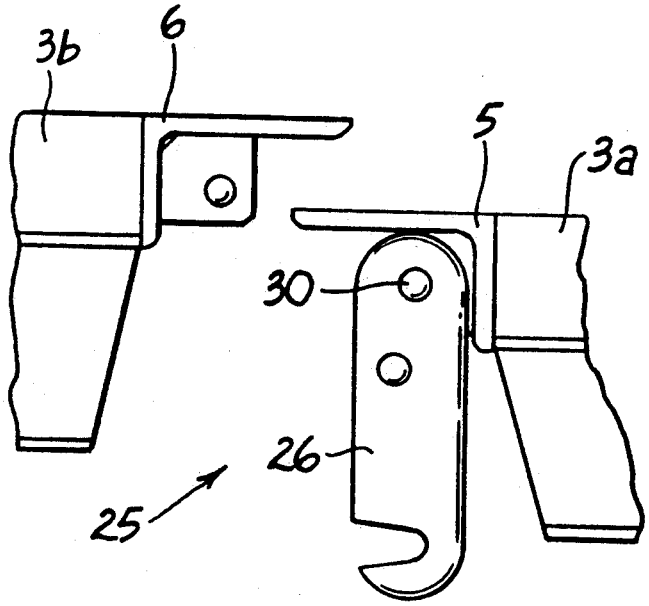
FIG. 1D shows the clamping lock according to the invention in its inoperatively hanging position, corresponding with the stripping position of FIG. 1C.

FIG. 1C shows the situation after the pouring and curing of two vertical walls 8*a* and a floor 7*a* bridging said walls. To remove the tunnel shuttering from the thus formed concrete tunnel, the two tunnel shuttering sections are disconnected so that the connecting link 26 of the coupling lock 25 swings about its permanent pivot pin into a downwardly hanging position (vide FIG. 2D). Thereupon the right-hand tunnel section has been released from the just finished floor 7*a* by adjusting the right-hand jack(s) 14 and the right-hand support wheels 12 to a smaller height, after a number of roll blocks 15 have been initially placed under a rail 16 that is provided at the lower end of the upright shuttering panel 2. In this way the right-hand tunnel section is supported on the wheels and the roll blocks and may thus be rolled outwardly. The described operation may then be repeated for the left-hand tunnel shuttering section.

Figure 2A:
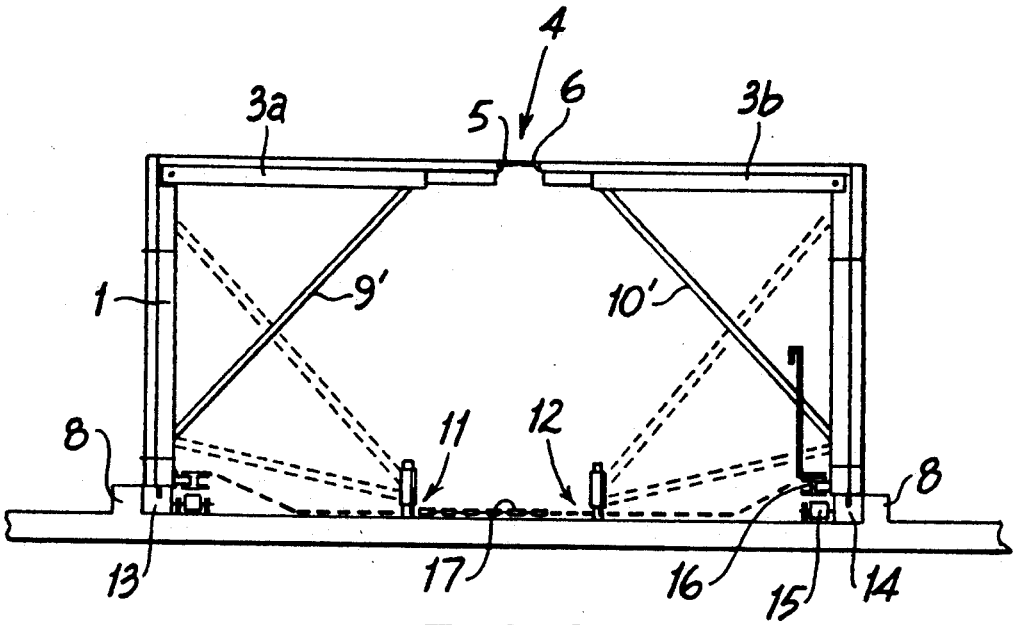
FIG. 2A shows a diagrammatic end view of a tunnel shuttering according to the full-tunnel-mode, in the coupled or shuttering position.

FIG. 2A shows the tunnel shuttering as used according to the full tunnel mode and in the position ready for pouring. In a manner similar to that of FIG. 1A the horizontal flanges of the angle irons 5 and 6 lie in one plane, while the longitudinal edges of these flanges substantially touch each other. The shuttering panels 1 and 2 are laterally supported by the "ridges" 8 at their lower ends and have been adjusted to the desired height by means of the jacks 13 and 14. As distinguished from the procedure described with reference to FIG. 1A-1D, the shuttering of FIG. 2A-2D has been put in place as a whole due to the fact that in this case the two shuttering sections are permanently connected by the coupling lock 25.

Figure 2B:
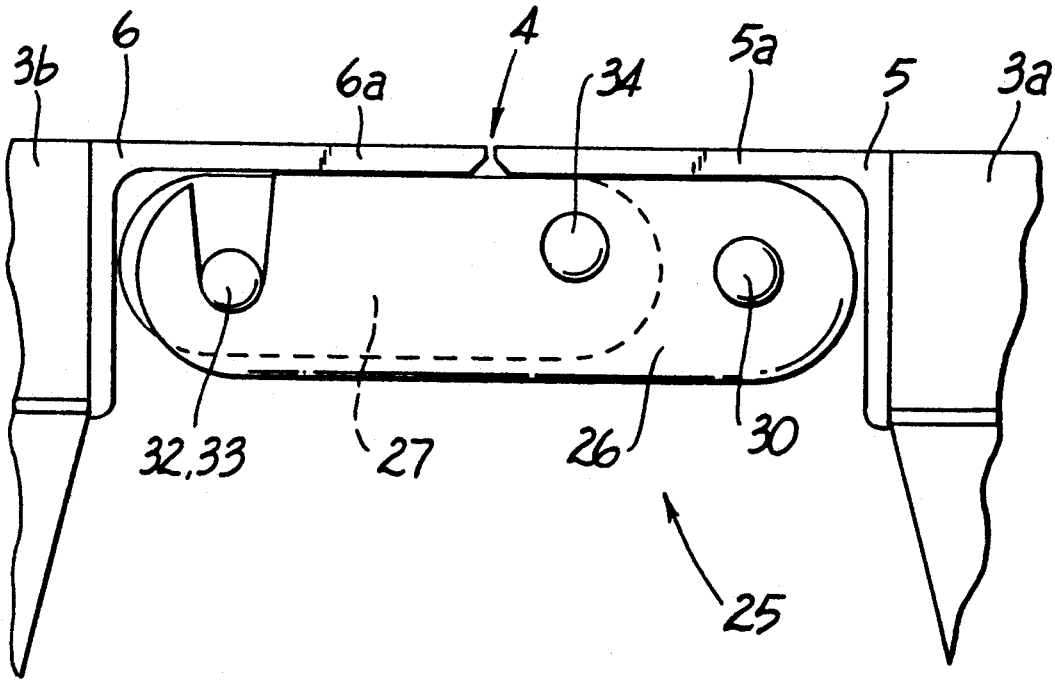
FIG. 2B shows the clamping lock according to the invention, that connects the two tunnel shuttering sections of FIG. 1A, showing also the auxiliary link, while the locking rod is omitted.
Figure 2C:
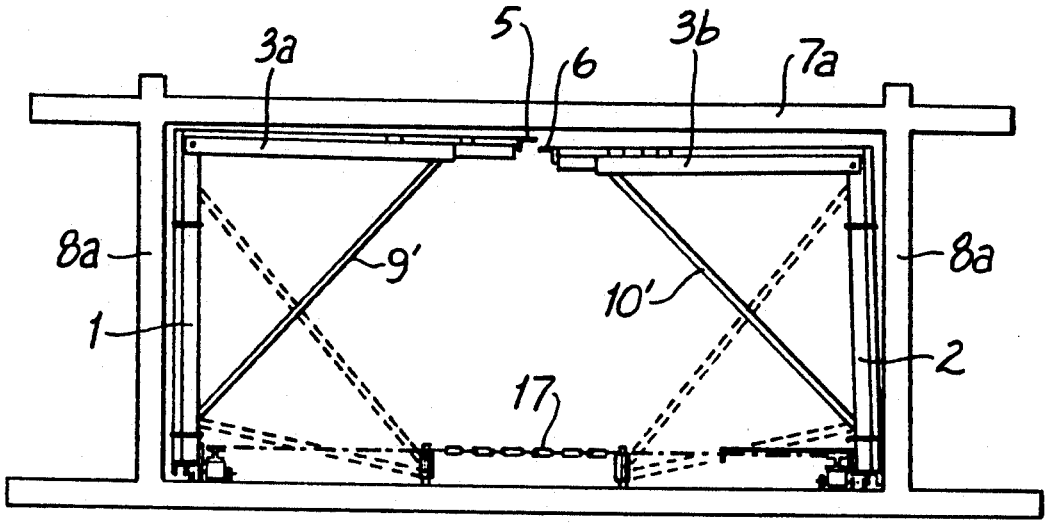
FIG. 2C shows the tunnel shuttering of FIG. 2A in the stripping position.
Figure 2D:
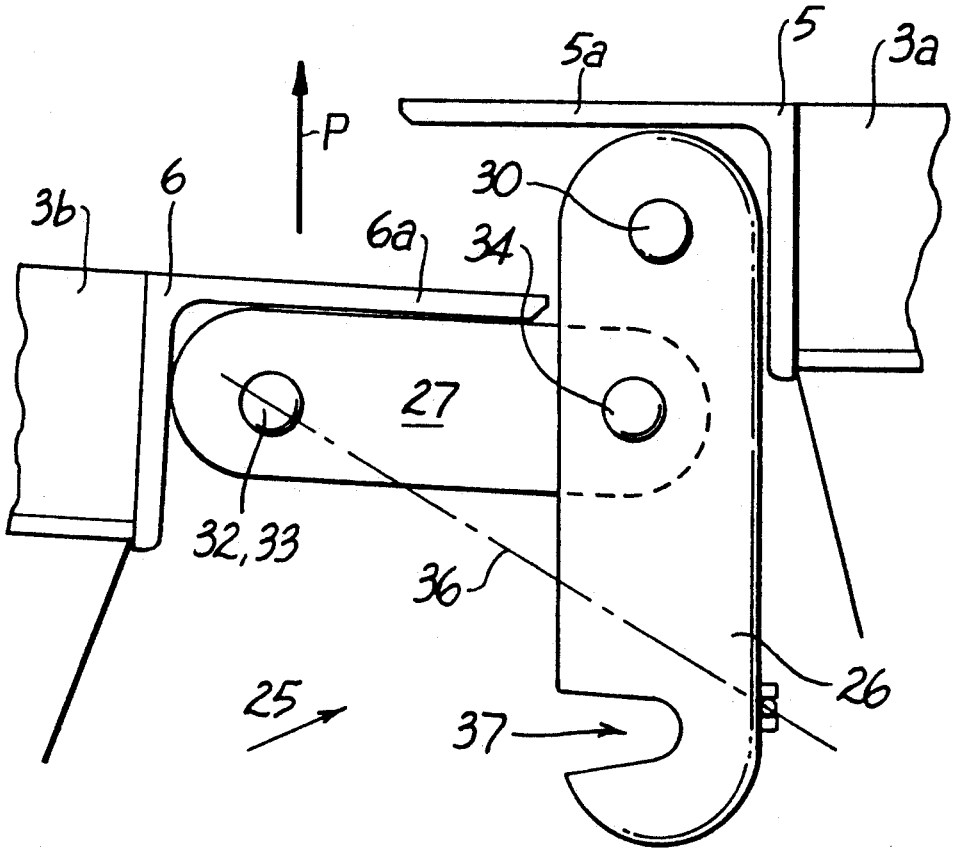
FIG. 2D shows the clamping lock in the unlocked position, corresponding with the stripping position of FIG. 2C.

The shuttering is put in place in a position wherein the upright shuttering panels are slightly pulled together by means of a tightened connecting chain 17, while the coupling lock 25 is in its downwardly hanging position (FIG. 2D). In this case a part of the support structures 9 and 10 required in the mode of FIG. 1A–1D has become superfuous and therefor has been indicated merely by dash lines in FIG. 2A–D. On the other hand, however, one of the braces 9' and 10' shown at full lines, (viz. the brace 10') is formed as a buckling rod, as is well known per se with "full tunnel systems".

Figure 3:
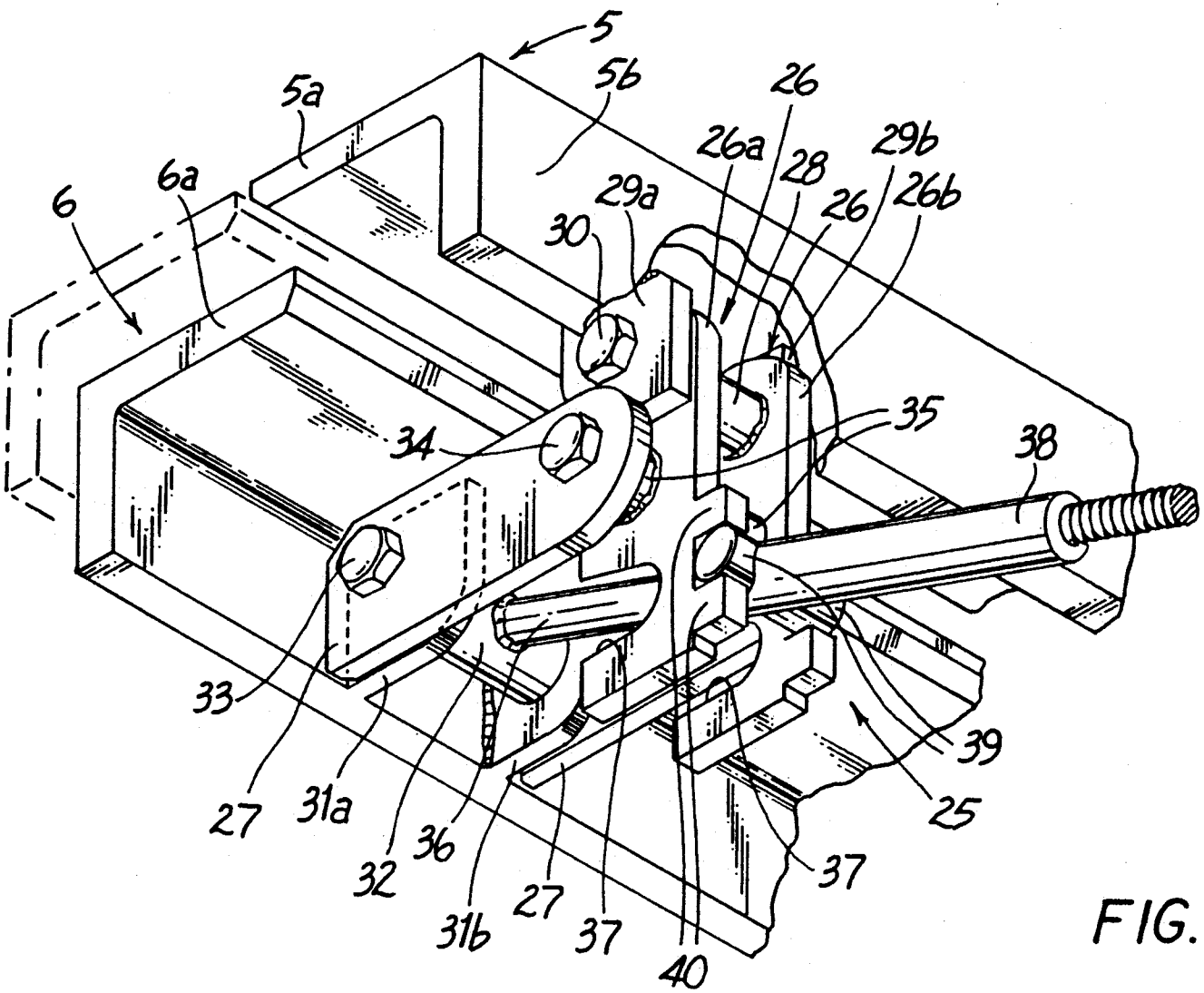
FIG. 3 is a perspective view, as seen from below, of the clamping lock according to the invention, including the auxiliary link.

After the tunnel shuttering has been placed onto the floor 7, the chain 17 is released, so that the upright shuttering panels 1 and 2 may spread apart to engage with the ridges 8. To bring the coupling lock 25 from the hanging position of FIG. 2D into the stretched position of FIG. 2B, an upwardly directed polling force P could be applied, e.g. by means of a crane, to the left-hand tunnel section in FIG. 2D. It will be understood, that the downwardly hanging connecting link 26 is then be urged to perform a leftwardly and upwardly directed swinging movement about its upper, permanent pivot pin and that the lock would thereby gradually move into the position of FIG. 2B. A different procedure (without using a crane) is possible, however, by making use of the locking rod, which has not been described so far. Reference is made to FIG. 3, showing a perspective view of the coupling lock 25 in its inoperative hanging position.

As shown in FIG. 3, the connecting link 26 is double and comprises two parts **26*a* and 26*b* which are spaced in the longitudinal direction of the tunnel and are connected to one another by means of a spacing bushing 28. The thus formed connecting link 26 is pivotally mounted between two brackets 29*a* and 29*b* welded in the dihedral angle of the angle iron 5, about a pivot pin 30 extending through said brackets and through the spacing bushing 28. In the position shown in FIG. 3 the connecting link 26 is hanging downwardly along the inner side of the vertical flange 5*b***.

In the dihedral angle of the angle iron 6 two brackets **31*a* and 31*b* are provided as by welding, between which a bushing 32 is pivotally mounted about a pivot pin 33**.

On the outer side of each bracket **31*a* and 31*b* respectively an auxiliary link 27 is pivotally mounted with one end about the same pivot pin 33. The two auxiliary links 27 take a substantially fixed position within the dihedral angle of the angle iron 6 and are at the other end pivotally mounted about a pin 34 at an intermediary location 35 of the connecting link 26. For this purpose a hub is provided, at the location 35, on the outer side of each of the two parts 26*a* and 26*b* through which the pivot pin 34 extends, the spacing between the outer end faces of said hubs corresponding with the spacing between the outer sides of the brackets 31*a* and 31*b***.

The two parts **26*a* and 26*b* of the connecting link 26 have each, adjacent its lower end, a slot-shaped opening 37 merging into a longitudinal edge (i.e. the left-hand vertically positioned longitudinal edge in FIG. 3). The bottom walls of the slots 37 are of a semi-cylindrical shape, whereas the two sidewalls of the slot are slightly diverging towards the respective longitudinal edge of the connecting link 26**.

The spacing between the two pivot pins 33 and 34 is equal to that between the pivot pin 34 and the axis of the semi-cylindrical portion of the slots 37, so that a clockwise rotary movement of the connecting link 26 about the pivot pin 34 will cause the slot-like openings 37 of the connecting link 26 to catch the bushing 32. Such a rotary movement may be effected in a simple manner by means of the locking rod now to be described. This locking rod is indicated at 36 in FIG. 3 and is welded to the bushing 32 that is rotatably mounted about the pivot pin 33. The rod 36 extends between the two parts **26*a* and 26*b* of the connecting link 26 towards the foreground of the drawing and has adjacent its free end a threaded portion 36*a*. A bushing-shaped pressure member 38 is loosely slidably mounted about the rod 36, said pressure member being provided with two laterally extending cylindrical projections 39 at the end facing the connecting link 26, said cylindrical projections engaging (in the position shown in the drawing) two corresponding receiving cavities, which are formed between spaced projections 40 on the longitudinal edges of the connecting link 26** facing towards the foreground of the drawing.

It will be understood that, when the bushing-like pressure member 38 is slides on the rod 36 to the right (i.e. towards the foreground) the cylindrical projections 39 will be released from their receiving cavities so that the rod 36 is permitted to swing towards a vertically downwardly hanging position. In reverse order the rod 36 may be swung from a vertically downwardly hanging position towards the position shown in the drawing, in which a sliding movement of the pressure member 38 to the left (towards the background) will place the member into engagement with the connecting link 26. By screwing a nut or a threaded collar onto the threaded end portion of the rod 36 and tightening said nut or collar by means of a suitable tool, the above mentioned rotary movement of the connecting link 26 will take place, thereby causing the angle iron 6 to be gradually elevated to the position indicated by the dash-dotted lines. In the course of this procedure the coupling lock is moving into its stretched position, corresponding with that of FIG. 2B. It is to be remarked, that in reality the rod 36 will extend under a much steeper angle; only for clarity's sake the spacing between the pivot pins 33 and 34 is shown somewhat exaggerated.

After the above it will be understood that the shuttering, which is shown in FIG. 3 for use according to the full-tunnel-mode, may be easily transformed into a shuttering for use according to the half-tunnel-mode by removing the auxiliary links 27.

A final remark concerns the manner in which the coupling lock 25 will get from the stretched position of FIG. 2A, 2B into the downwardly hanging position of FIG. 2C, 2D and FIG. 3. As remarked hereinabove it will be necessary to form the brace 10' as a "buckling" rod (=rod of a variable length) to bring the shuttering into the stripping position. Such a buckling rod will thus take its "buckling" position when the coupling lock 25 is hanging downwardly and will be automatically extended when said coupling lock (vide hereinabove) is elevated into its stretched position. The brace 10' is normally locked in its extended position so that it will actually serve as a support in the operative pouring position of the shuttering. When in this situation—with the brace 10' locked in its extended position—the pressure member 38 on the locking rod 36 is released, the shuttering and therewith the coupling lock will, in principle be held in the operative position. However, as soon as the brace 10' is unlocked, the shuttering will immediately drop into the stripping position—with the coupling lock hanging downwardly.

We claim:

1. A tunnel shuttering, comprising two upright shuttering panels and a horizontal shuttering panel bridging the space between the upright panels, said horizontal panel being divided into two sections along a longitudinally extending dividing line, each of said horizontal sections being rigidly connected at one longitudinal edge to an upright shuttering panel and delimited at its opposite longitudinal edge by an angle iron having a horizontal flange extending transversely substantially in the upper plane of the horizontal panel section, the free longitudinal edges of said flanges facing towards and substantially touching each other and means for coupling said horizontal panel sections together comprising a plurality of connecting links spaced along and at right angles to the longitudinal dividing line, each of said links being pivotally mounted at one end to the angle iron of one of said horizontal panel sections and having a slot opening on the upper edge of the connecting link and terminating in a bottom wall, a fixedly mounted pin extending longitudinally from the angle iron of the opposite horizontal panel section with which said slot is engageable, and a pivotally suspended locking rod provided with a pressure member mounted to be slidable along said rod and to be fixed relative to said rod, said pressure member being adapted to engage said connecting link to urge said connecting link to enter with its slot-shaped opening into engagement with the respective pin.

2. A tunnel shuttering according to claim 1, characterized in that the locking rod is pivotally mounted about the fixedly mounted pin.

3. A tunnel shuttering according to claim 1, characterized in that the pivot pins are positioned between brackets provided in the dihedral angle of the respective angle irons, in such a way, that the connecting links—in the pouring position—have their upper edges in direct contact with the lower faces of the aligned horizontal angle iron flanges.

4. A tunnel shuttering according to claim 1, characterized in that an auxiliary link of shorter length is provided, having one end in permanent engagement with the pin cooperating with the slot-shaped opening of the connecting link and having its other end pivotally mounted about a pin extending from the connecting link at an intermediary point of the latter.

5. A tunnel shuttering according to claim 4, characterized in that in the downwardly hanging inoperative end position of the connecting link, the third intermediate pivot pin is positioned slightly offset—towards the locking rod carrying pivot pin—relative to the vertical line through the upper, permanent pivot pin.

6. A tunnel shuttering according to claim 1, characterized in that the connecting link is a double link and that the two link halves are interconnected by a tubular spacer element that surrounds said permanent pivot pin.

7. A tunnel shuttering according to claim 6, characterized in that the locking rod is radially extending from a bushing that is mounted about the pin that cooperates with the slot-shaped opening(s) of the connecting link, said locking rod extending—in the locking position—through the space between the connecting link halves towards the opposite longitudinal edge(s) of the connecting link.

8. A tunnel shuttering according to claim 7, characterized in that the pressure member is formed by a tubular member provided on the locking rod portion that extends beyond the connecting link, said member having at its connecting link facing end two diametrically outwardly extending cams, which may engage corresponding receiving cavities formed at the opposite longitudinal edges of the connecting link halves, the free locking rod end portion being provided with external threading and carrying a nut member, by means of which the tubular member may be displaced towards the locking rod carrying pivot pin.

9. A tunnel shuttering according to claim 4, characterized that an auxiliary link is provided on the outerside of each of the two brackets that support the pivot pin and the locking rod, the two connecting link halves being locally, i.e. at the pivot connection with the auxiliary links, outwardly widened by hubs to an overall width that corresponds with the external spacing between the support brackets.

10. A tunnel shuttering according to claim 9, characterized in that the auxiliary links have a substantially fixed angular position within the dihedral angle of the respective angle iron.

* * * * *

UNITED STATES PATENT AND TRADEMARK OFFICE

CERTIFICATE OF CORRECTION

PATENT NO. : 5,269,633

DATED : December 14, 1993

INVENTOR(S) : Cornelis de Roo et al.

It is certified that error appears in the above-identified patent and that said Letters Patent is hereby corrected as shown below:

On the title page, item [30] should read as follows:

[30] Foreign Application Priority Data
Jul. 10, 1991 [NL] The Netherlands.....9101215

Signed and Sealed this

Seventeenth Day of May, 1994

Attest:

Bruce Lehman

BRUCE LEHMAN

Attesting Officer

Commissioner of Patents and Trademarks